US008371191B2

(12) United States Patent
Huang

(10) Patent No.: US 8,371,191 B2
(45) Date of Patent: Feb. 12, 2013

(54) WRENCHING DEVICE

(75) Inventor: Ping-Wen Huang, Taichung (TW)

(73) Assignee: New Way Tools Co., Ltd., Taichung (TW)

( * ) Notice: Subject to any disclaimer, the term of this patent is extended or adjusted under 35 U.S.C. 154(b) by 238 days.

(21) Appl. No.: 12/938,484

(22) Filed: Nov. 3, 2010

(65) Prior Publication Data

US 2011/0132154 A1 Jun. 9, 2011

(30) Foreign Application Priority Data

Dec. 8, 2009 (TW) ..... 98141961 A

(51) Int. Cl.
*B25B 23/10* (2006.01)

(52) U.S. Cl. ..... 81/444; 81/453

(58) Field of Classification Search ..... 81/444, 81/445, 453

See application file for complete search history.

(56) References Cited

U.S. PATENT DOCUMENTS

| | | | | | |
|---|---|---|---|---|---|
| 878,457 | A * | 2/1908 | Deller | 29/267 |
| 1,432,121 | A * | 10/1922 | Prickett | 279/2.12 |
| 2,226,078 | A * | 12/1940 | Spahn | 279/2.15 |
| 2,320,435 | A * | 6/1943 | Hood | 72/393 |
| 2,814,098 | A * | 11/1957 | Kessell | 29/267 |
| 4,724,608 | A * | 2/1988 | Parrott | 29/724 |
| 5,025,688 | A * | 6/1991 | Davis | 81/448 |
| 6,286,401 | B1 * | 9/2001 | Hajianpour | 81/453 |
| 7,040,202 | B2 * | 5/2006 | Hsien | 81/453 |
| 7,448,303 | B2 * | 11/2008 | Sweat et al. | 81/444 |

* cited by examiner

*Primary Examiner* — David B Thomas
(74) *Attorney, Agent, or Firm* — Alan Kamrath; Kamrath IP Lawfirm, P.A.

(57) ABSTRACT

A wrenching device includes a driving member, a hole and at a slit defined therein, and defines an engaging portion. The slit communicates with the hole. The wrenching device further includes an actuating member moveably disposed in the hole of the driving member, and a control member including a connecting end pivotally joining to the actuating member and including first and second engaging sides selectively abutting against a wall defined on the driving member in response to first and second operating positions thereof, respectively.

8 Claims, 16 Drawing Sheets

WRENCHING DEVICE

BACKGROUND OF THE INVENTION

1. Field of the Invention

The present invention relates to a wrenching device and, particularly, to a wrenching device best used for loosening a rusted and rotten fastener, or, a fastener which corners have been damaged.

2. Description of the Related Art

It is known that a type of fastener includes a head and a hole defined in the head adapted for engagement with a wrenching device used to tighten/loosen the fastener. Generally, the wrench device is an Allen wrench. Unfortunately, if the hole is damaged, i.e., the corners of the hole become arcuate and are no longer acute, the wrenching device would suffer a problem to engage fixedly in the hole, and, therefore, it turns relative to the fastener when being turned in connection with the fastener. Under such circumstance, one conventional way to remove the damaged fastener out of an object is by splitting the fastener in half so that each piece can be taken out individually, and another way is by drilling a hole in the fastener for a pulling member and drawing the pulling member with a tool to take the fastener out. However, both conventional ways are troublesome and will make the fastener no longer suitable for next uses.

The present invention is, therefore, intended to obviate or at least alleviate the problems encountered in the prior art.

SUMMARY OF THE INVENTION

According to the present invention, a wrenching device includes a driving member extending from a first end to a second end and including a hole and at a slit defined therein. The first end defines an engaging portion. The slit communicates with the hole. The wrenching device further includes an actuating member moveably disposed in the hole of the driving member, and a control member including a connecting end pivotally joining to the actuating member and including first and second engaging sides selectively abutting against a wall defined on the driving member in response to first and second operating positions thereof, respectively. Furthermore, the actuating member is moved in a direction urging the engaging portion to expand radially out as the control member is pivoted from the first to the second operation position.

It is an object of the present invention to provide a wrenching device that has a simple structure.

It is another object of the present invention to provide a wrenching device that has an engaging portion adapted to be expanded radially out to push or abut against a peripheral wall of the hole in a manner to prevent rotation with respect to the fastener when being turned.

Other objects, advantages, and new features of the present invention will become apparent from the following detailed description of the invention when considered in conjunction with the accompanied drawings.

DETAILED DESCRIPTION OF THE PREFERRED EMBODIMENTS

Figure 1:
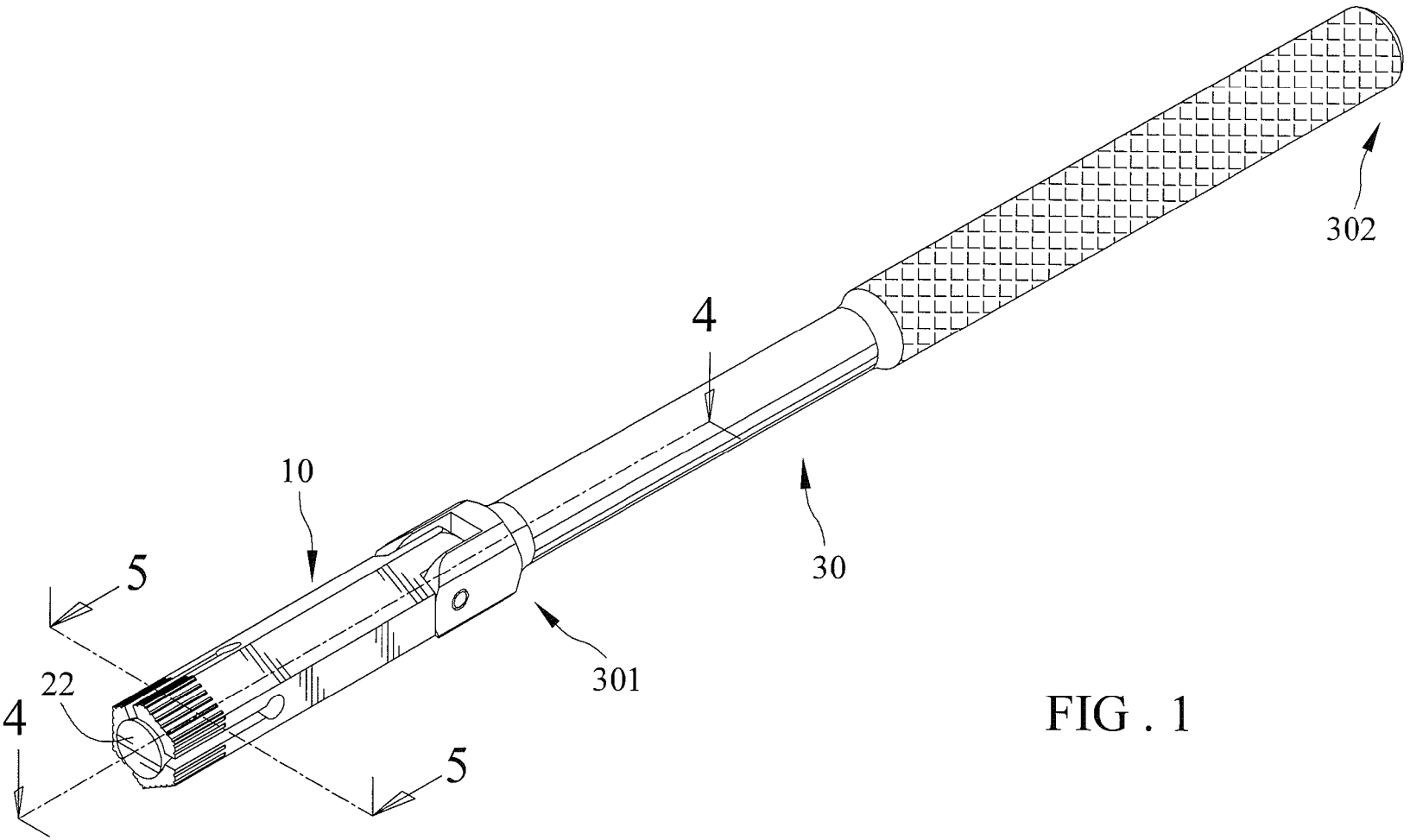
FIG. 1 is a perspective view of a wrenching device in accordance with a first embodiment of the present invention.
Figure 2:
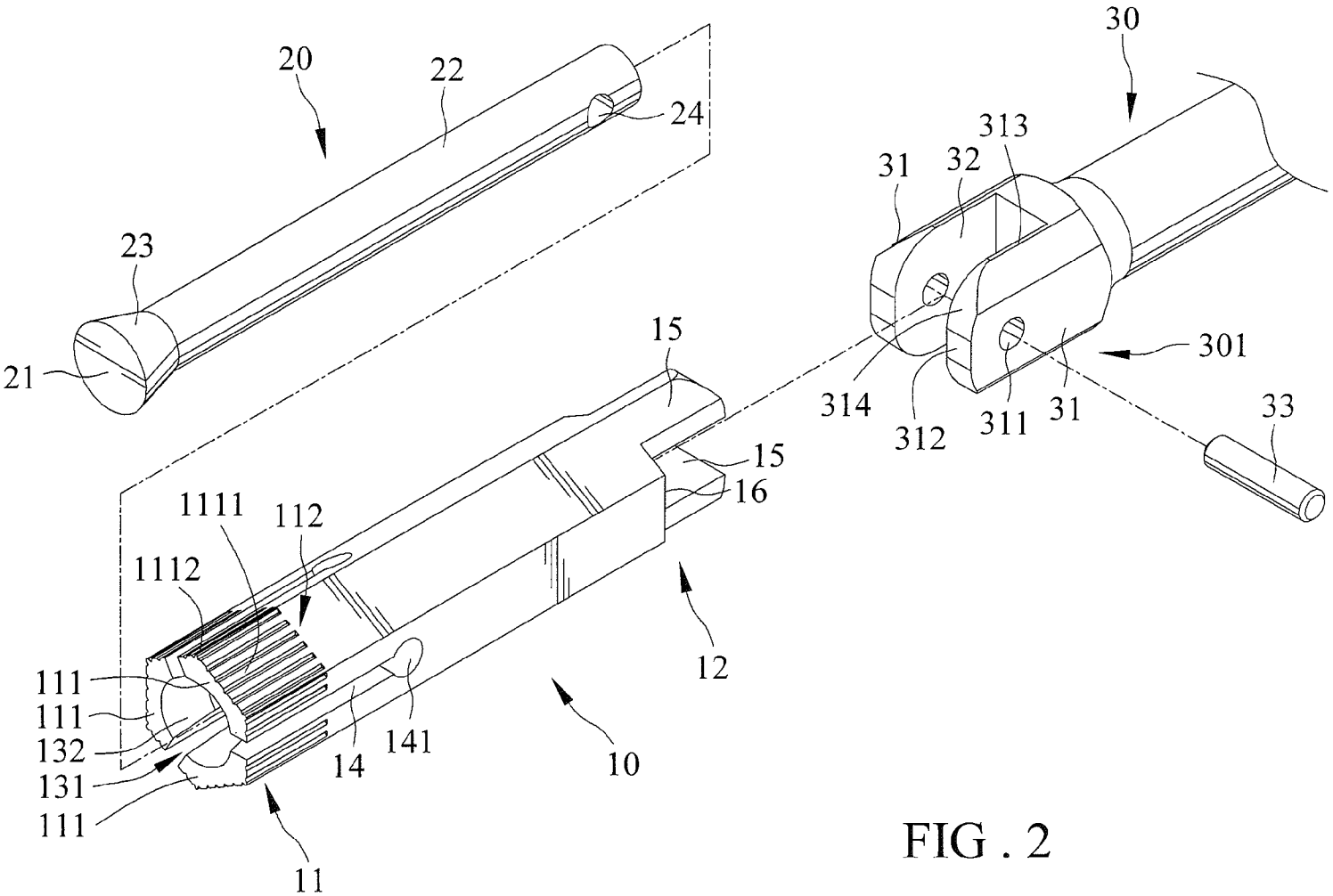
FIG. 2 is an exploded perspective view of the wrenching device.
Figure 3:
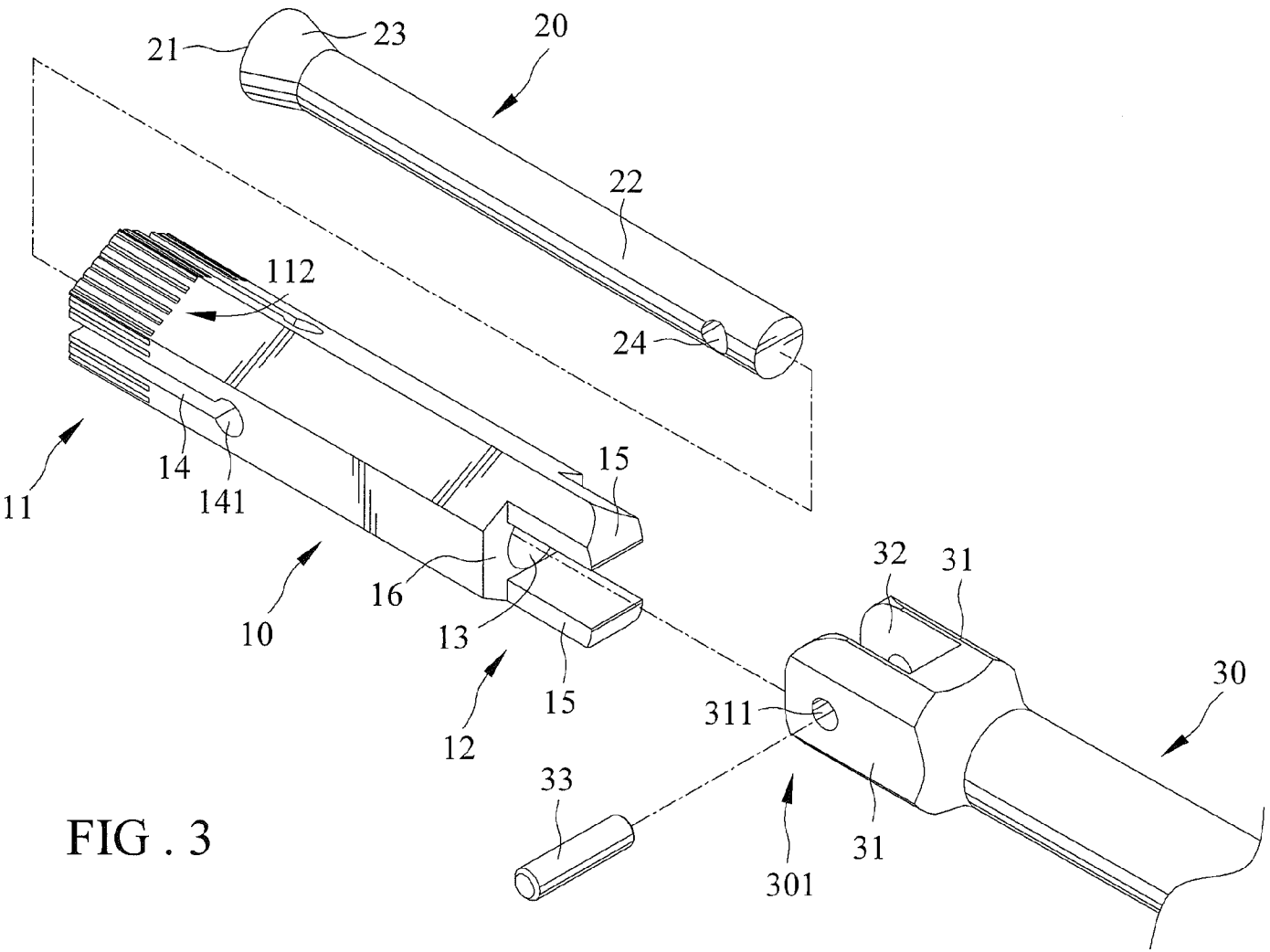
FIG. 3 is another exploded perspective view of the wrenching device.
Figure 4:
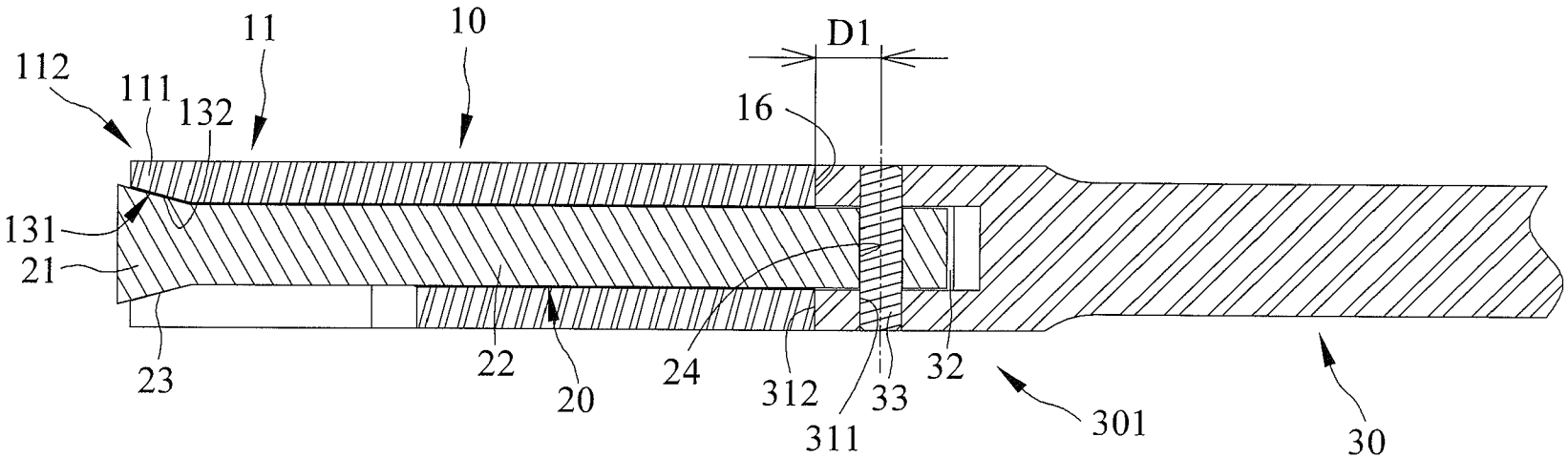
FIG. 4 is a cross-sectional view taken along line 4-4 of FIG. 1.
Figure 5:
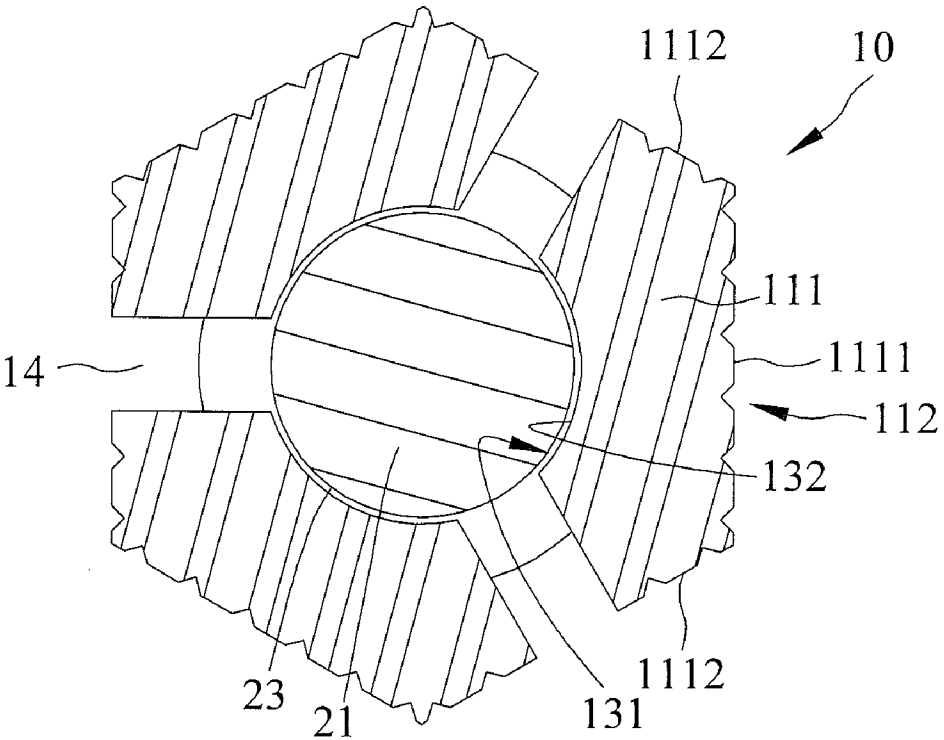
FIG. 5 is a cross-sectional view taken along line 5-5 of FIG. 1.
Figure 6:
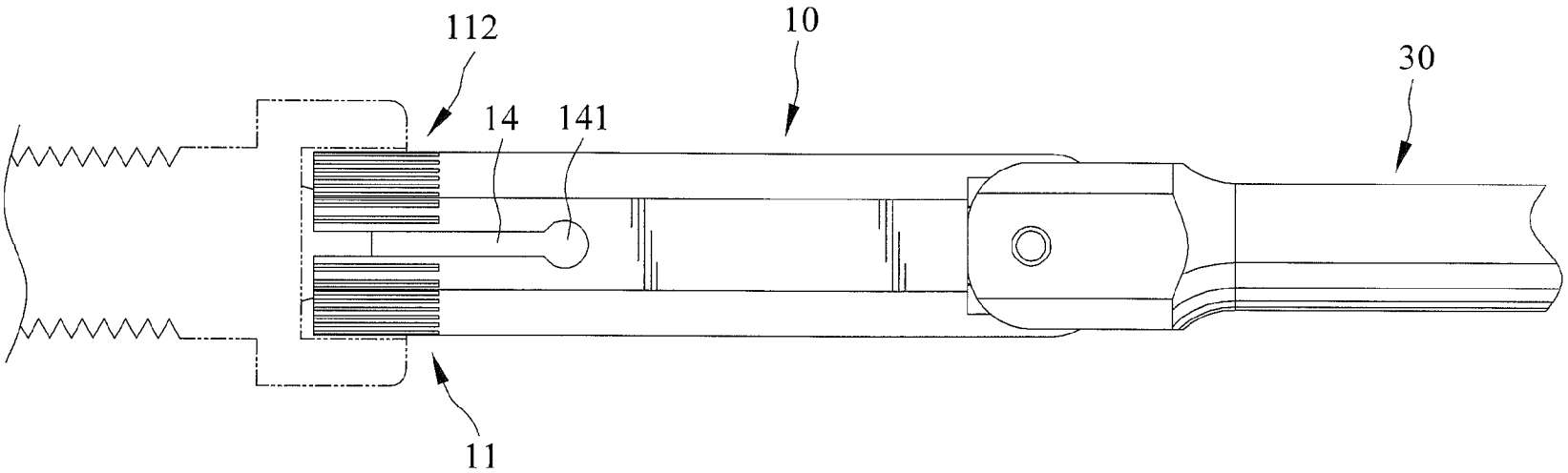
FIG. 6 shows the wrenching device in a first operating position and inserted into a hole defined in a head of a fastener, with the fastener shown in phantom.
Figure 7:
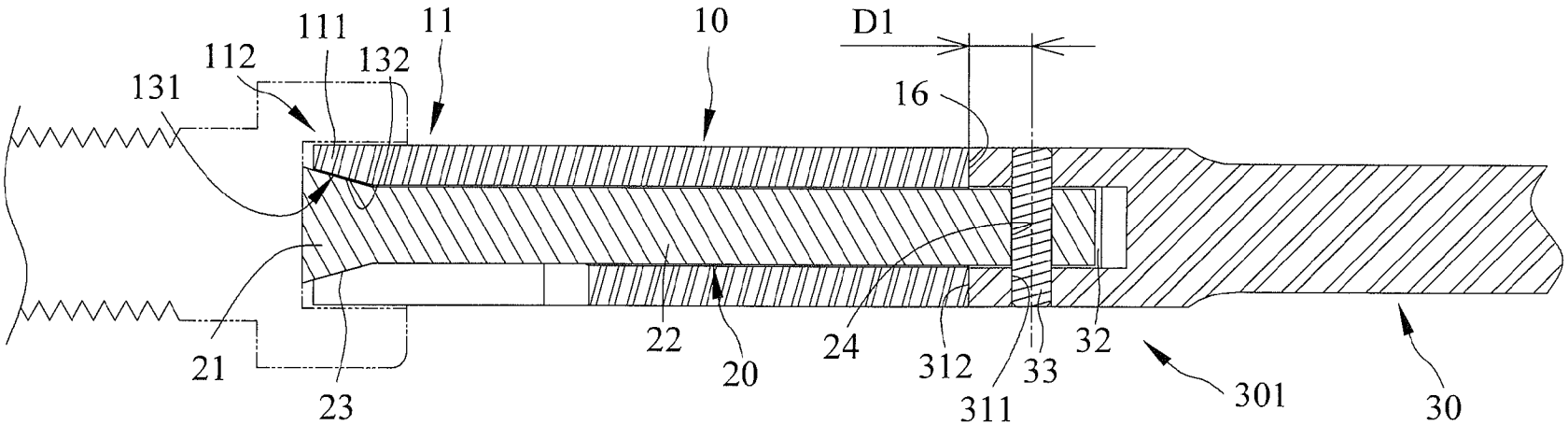
FIG. 7 is a cross-sectional view of the wrenching device and the fastener shown in FIG. 6.
Figure 8:
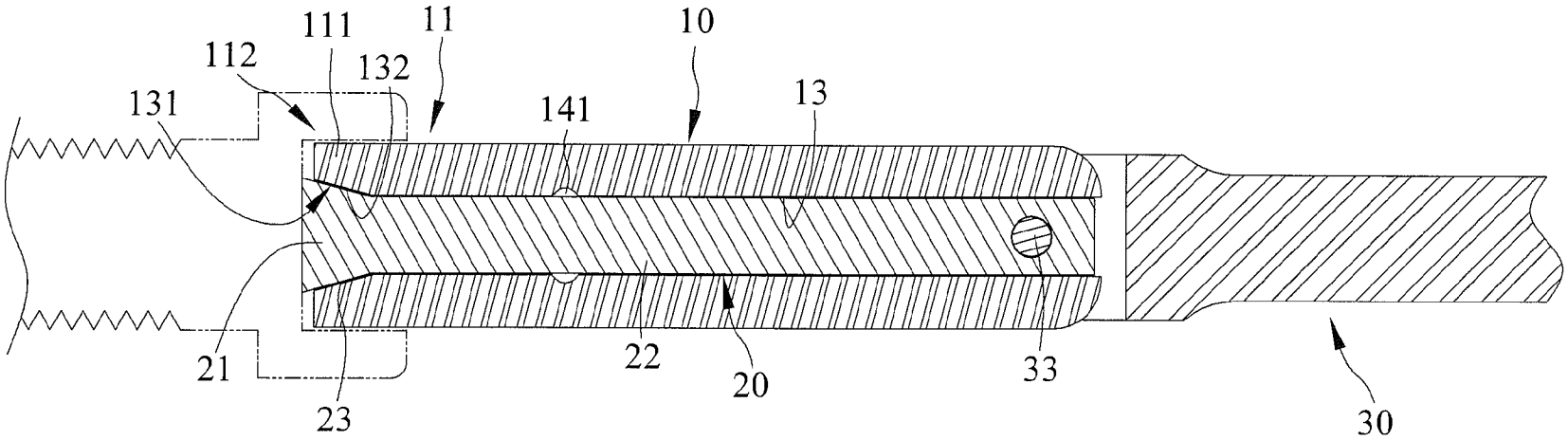
FIG. 8 is another cross-sectional view of the wrenching device and the fastener shown in FIG. 6.
Figure 9:
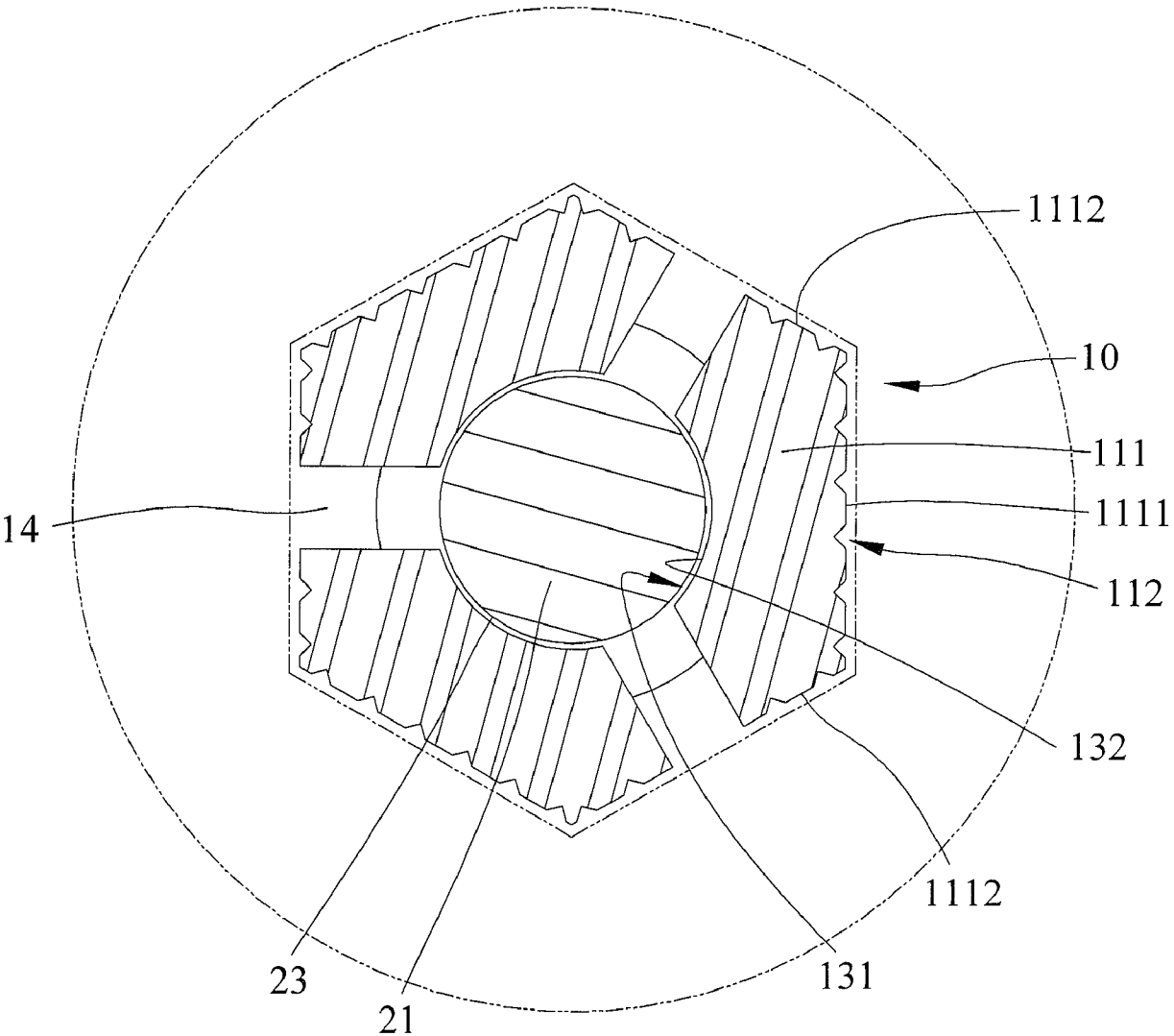
FIG. 9 is yet another cross-sectional view of the wrenching device and the fastener shown in FIG. 6.
Figure 10:
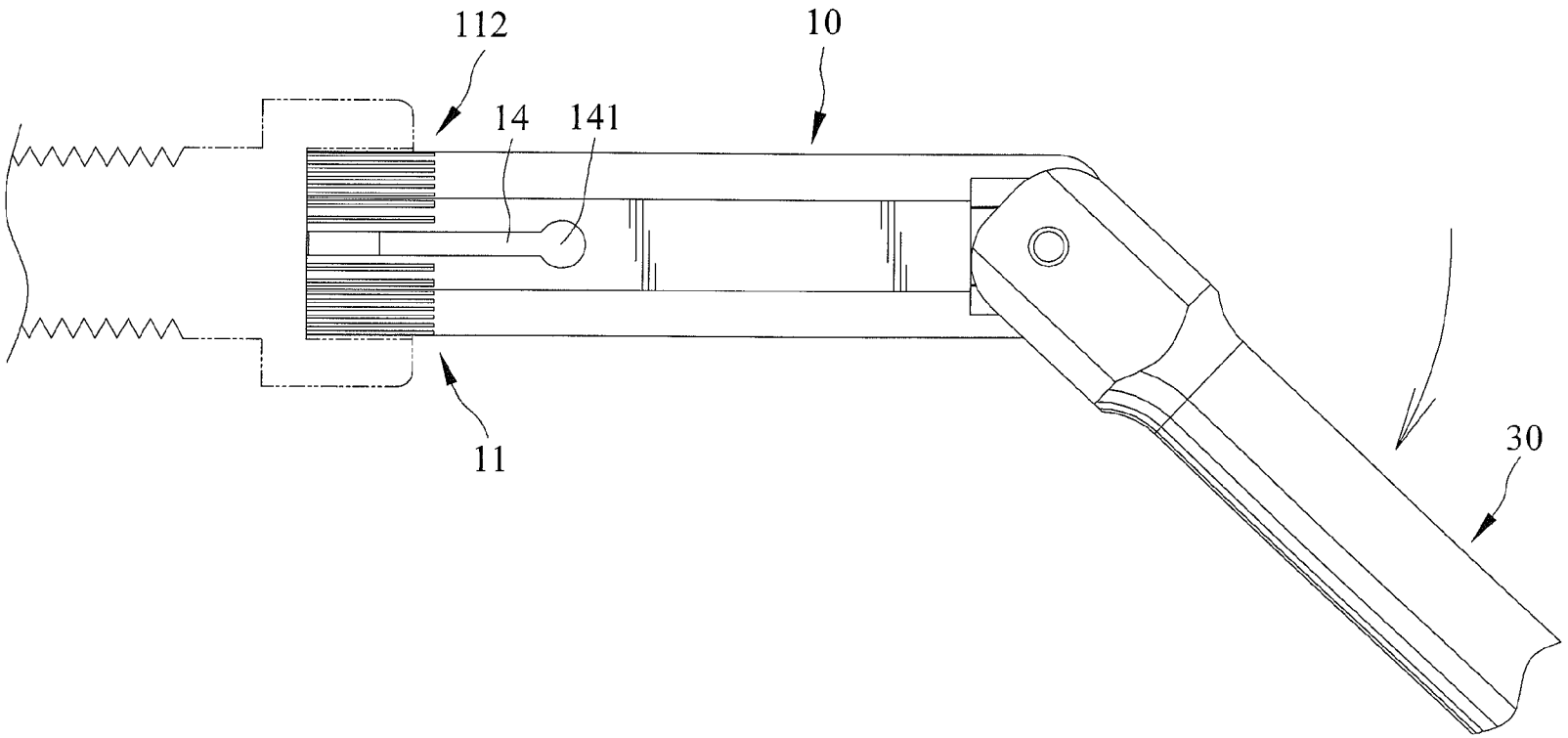
FIG. 10 is an extended view of FIG. 6 and shows the operation of the wrenching device to a second operating position thereof.
Figure 11:
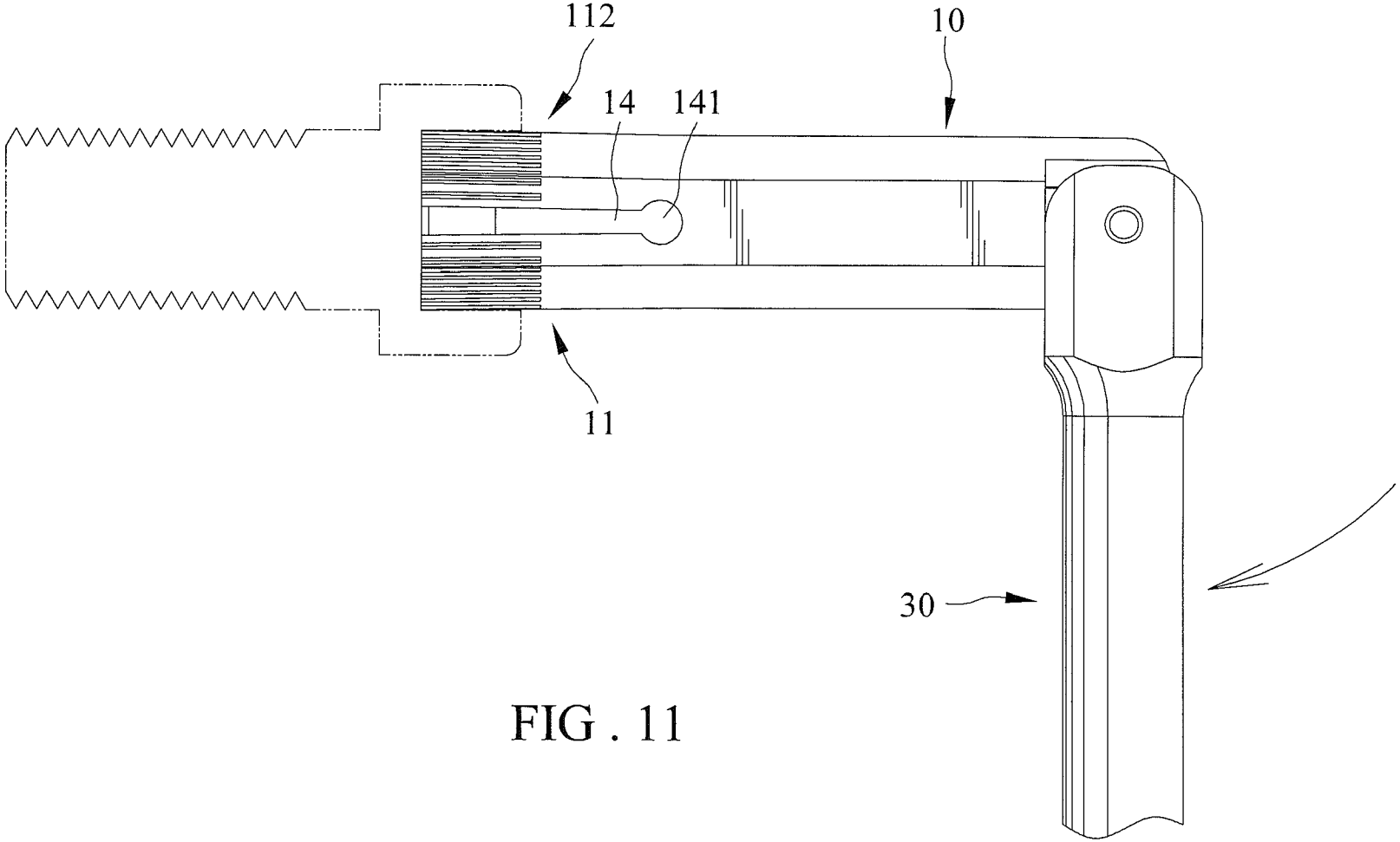
FIG. 11 shows the wrenching device in the second operating position.
Figure 12:
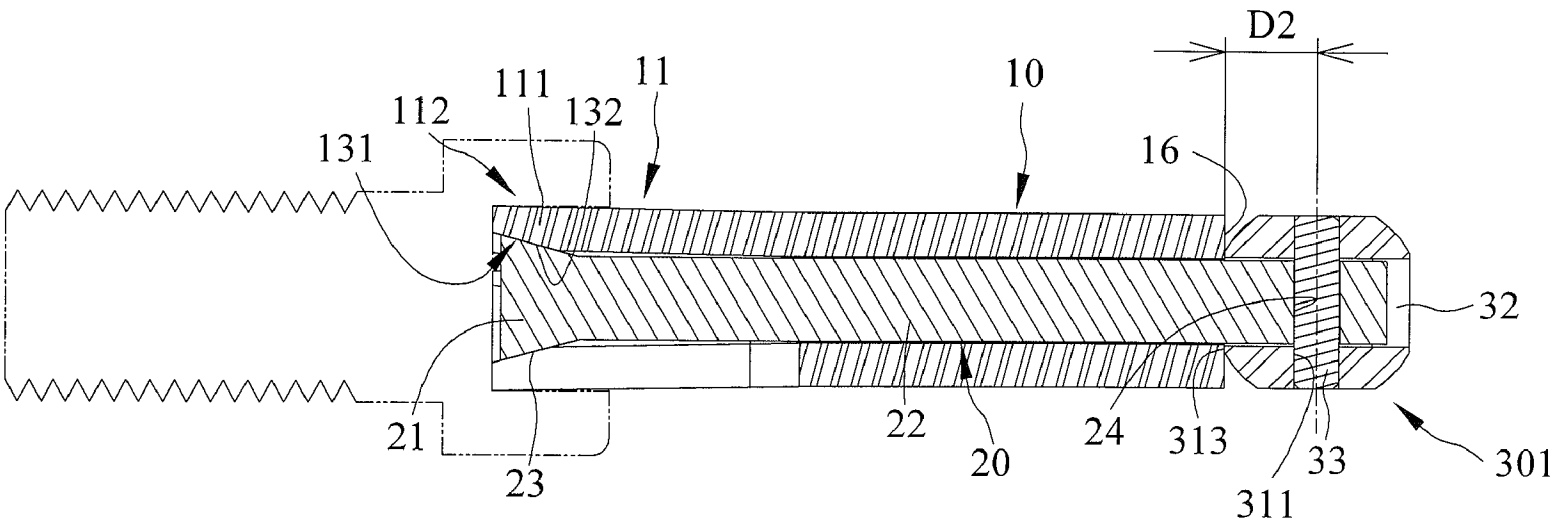
FIG. 12 is a cross-sectional view of the wrenching device and the fastener shown in FIG. 11.
Figure 13:
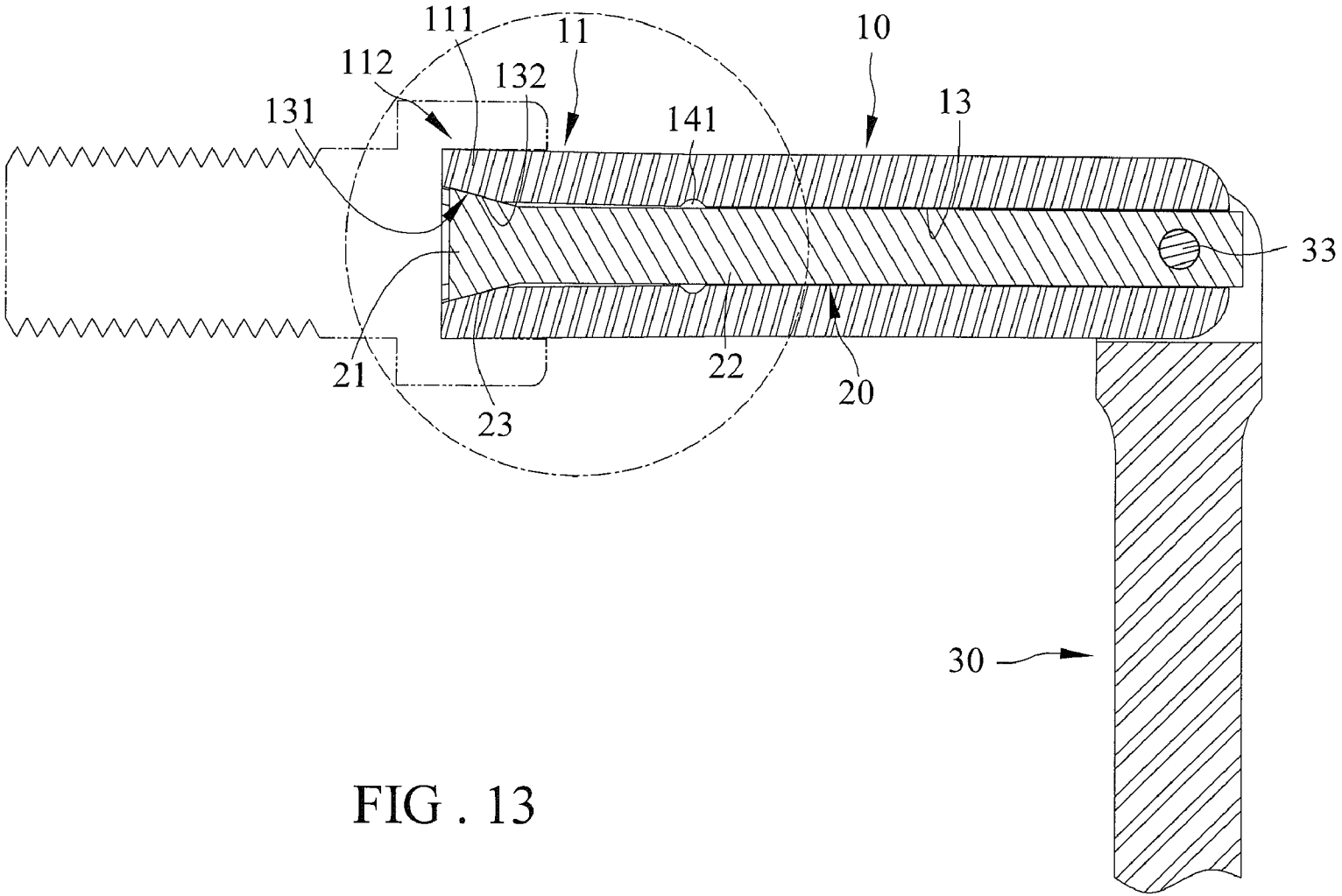
FIG. 13 is another cross-sectional view of the wrenching device and the fastener shown in FIG. 11.
Figure 14:
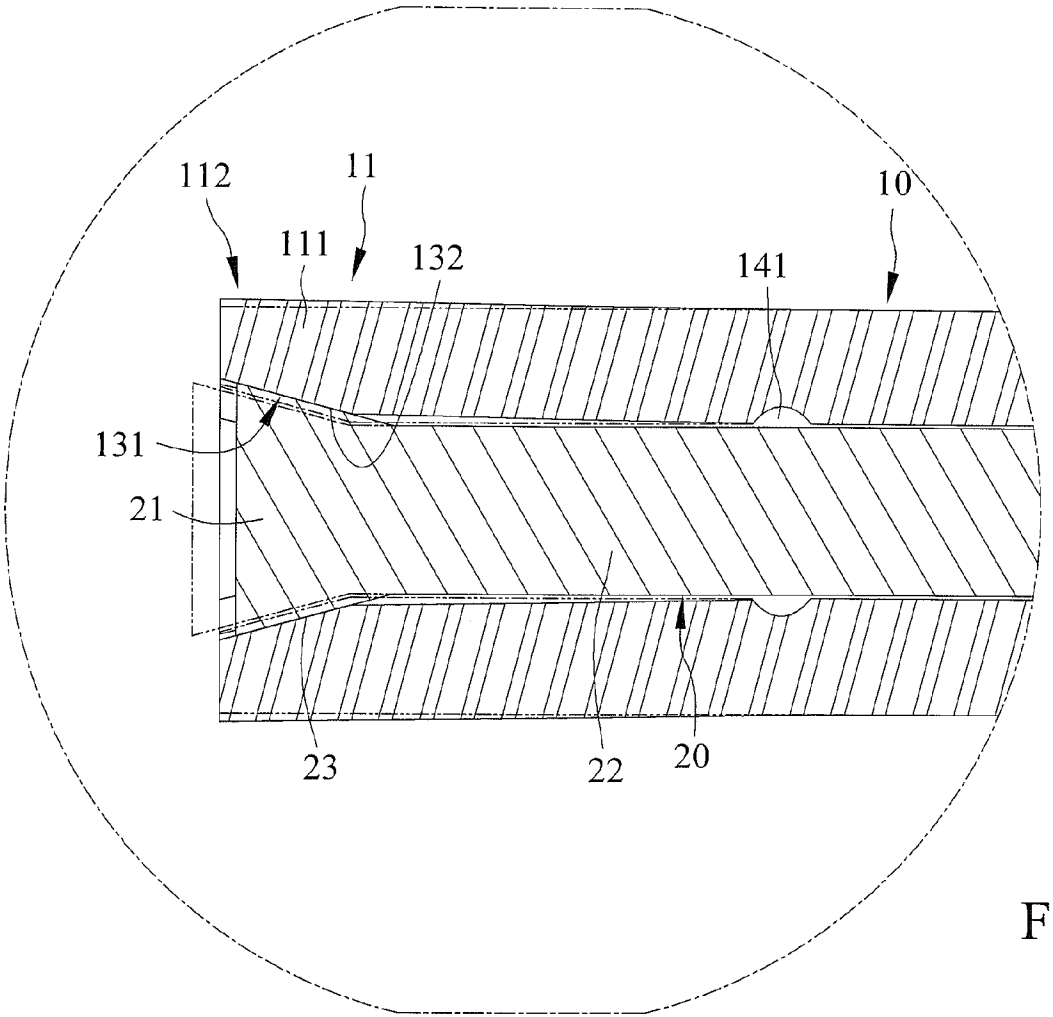
FIG. 14 is a partial, enlarged view of FIG. 13.
Figure 15:
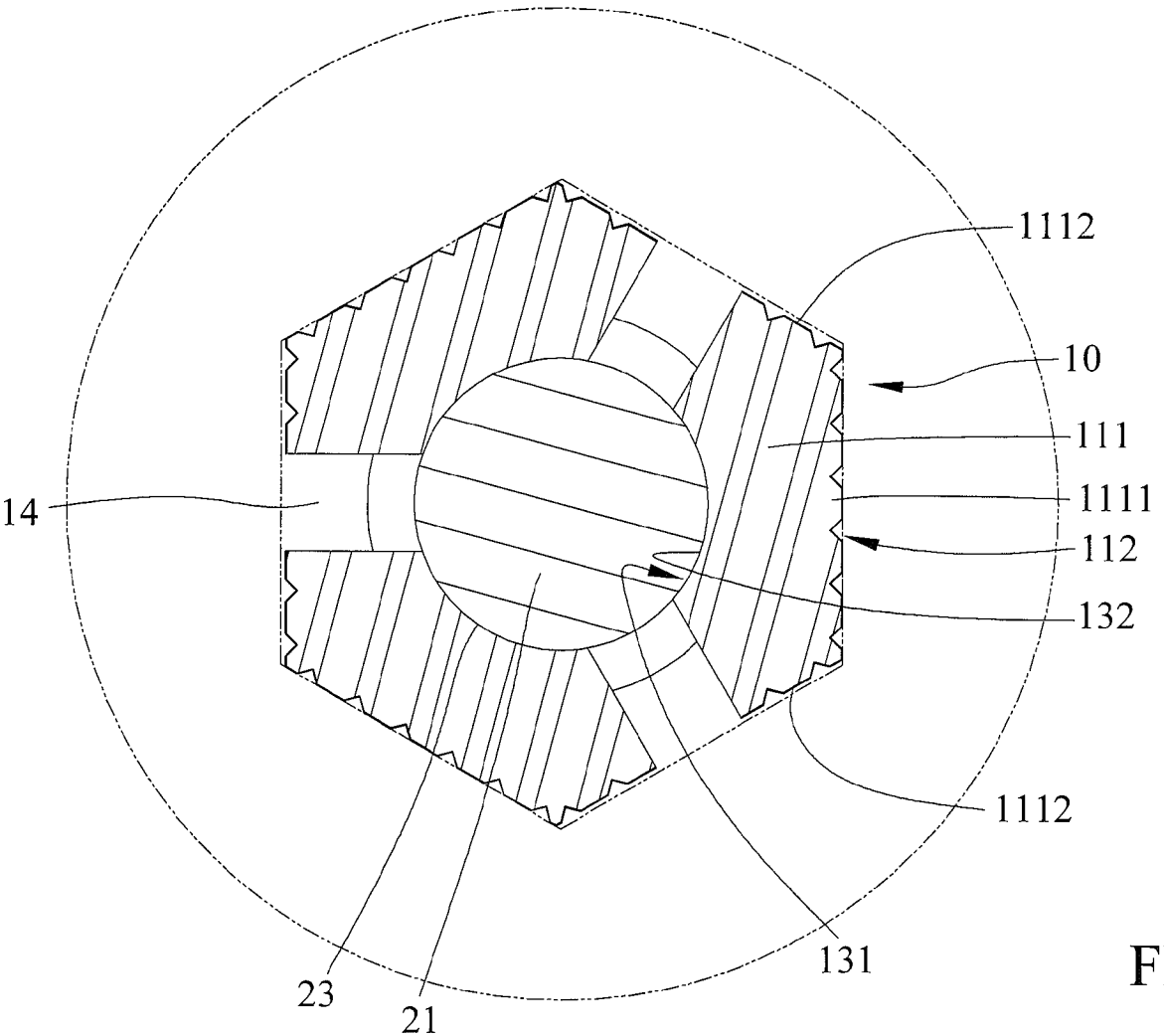
FIG. 15 is yet another cross-sectional view of the wrenching device and the fastener shown in FIG. 11.
Figure 17:
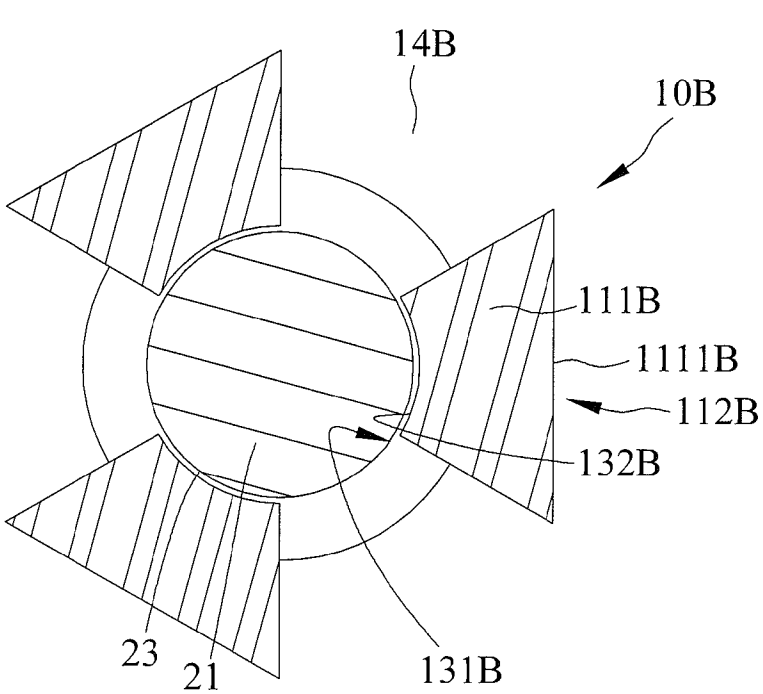
FIG. 17 is a cross-sectional view of a wrenching device in accordance with a third embodiment of the present invention.

A wrenching device includes a driving member 10, an actuating member 20, and a control member 30. The driving member 10 extends from a first end 11 to a second end 12 and includes an inner periphery and an outer periphery circumferentially surrounding the inner periphery as well as a hole 13 extending from the first end 11 to the second end 12 and delimited by the inner periphery. A plurality of slits 14 extend radially from the inner periphery to the outer periphery and longitudinally from the first end 11 to a position between the first and second ends 11 and 12. Two lugs 15 extend from a wall 16 which extends radially from the inner periphery to the outer periphery of the driving member 10 and is defined at the second end 12 thereof. The hole 13 includes a tapered section 131 delimited by a tapered wall 132 defined from the inner periphery of the driving member 10 and extending from the first end 11. The hole 13 has a first cross sectional size to a position between the first and second ends 11 and 12 and has a second cross section size which is reduced from the first cross sectional size. Each slit 14 is circumferentially spaced with respect to each other. Each slit 14 includes two spaced lateral walls and a first distal end defining an opening and a second distal end opposite to the first distal end and defining a closed end 141 which has a diameter larger than a distance between the lateral walls. The two lugs 15 are spaced from and opposing to each other. Furthermore, the first end 11 of the driving member 10 includes an engaging portion 111 defined thereon and including a plurality of segments, with two adjacent segments separated by one slit 14. An auxiliary engaging portion 112 is disposed on the engaging portion 111 and on the outer periphery of the driving member 10 and includes a plurality of channels, which are circumferentially spaced with respect to each other. Additionally, in a first embodiment thereof, the driving member 10 is of a polygonal cross section. Each segment of the engaging portion 111 includes a first engaging surface 1111 and two second engaging surfaces 1112 defined on the outer periphery of the driving member 10, and the two second engaging surfaces 1112 are interconnected by the first engaging surface 1111. In addition, the first engaging surface 1111 is angled with respect to each second engaging surface 1112. The actuating member 20 includes a head 21 and a body 22, is received in the hole 13, and is moveable in the hole 13. The head 21 is defined at a first distal end of the body 22 and is received in the tapered section 131 of the hole 13. The head 21 includes a circumferential wall 23 which urges the engaging portion 111 to expand radially out as the actuating member 20 is moved towards the second end 12 of the driving member 10. In the preferred embodiment, the circumferential wall 23 is of a tapered shape and has a gradually increased cross-sectional size as it extends away from the body 22. The body 22 includes a second distal end opposite to the first distal end extended outside the hole 13 and disposed between the two lugs 15. Further, an orifice 24 extends through the body 22 and transversely to a longitudinal length thereof, and is disposed outside the hole 13. The control member 30 includes a first distal end defining a connecting end 301 pivotally joining to the actuating member 20 and including first and second engaging sides selectively abutting against the wall 16 in response to first and second operating positions of the control member 30, respectively. In addition, the actuating member 20 is moved towards the second end 12 as the control member 30 is pivoted from the first to the second operation position. The connecting end 301 includes two lugs 31 each including an aperture 311 extending therethrough. First and second engaging sides 312 and 313 have respective perpendicular distances "D1" and "D2" with respect to a center of the aperture 311 and abutting against the wall 16 in response to the first and second operating positions of the control member 30 respectively. An arcuate edge 314 is defined between the first and second engaging sides 312 and 313 that facilitates the operation of the control member 30 between the first and second operating positions. The actuating member 20 is pivotally connected by an axle 33 inserted through the one aperture 311, the orifice 24, and the other aperture 311 successively. In addition, distance "D1" is smaller than distance "D2", and the lugs 31 includes a receptacle 32 defined therebetween receiving the lugs 15. The control member 30 further includes a second distal end opposite to the first distal end and defining a holding end 302 adapted to be grasped during the operation of the wrenching device.

In use of the wrenching device to tighten/loosen a fastener, the engaging portion 111 is initially inserted into a hole defined in the fastener. Then, the control member 30 is pivoted from the first to the second operating position to cause the actuating member 20 to move in a direction that results in the engaging portion 111 expanding radially out and the first and second engaging surfaces 1111 and 1112 thereof pushing or abutting against a peripheral wall of the hole. That is, the engaging portion 111 is prevented from rotation with respect to the fastener when being turned. Additionally, each slit 14 has a satisfactory ability to resist crack formation when the engaging portion 111 expands radially out.

Figure 16:
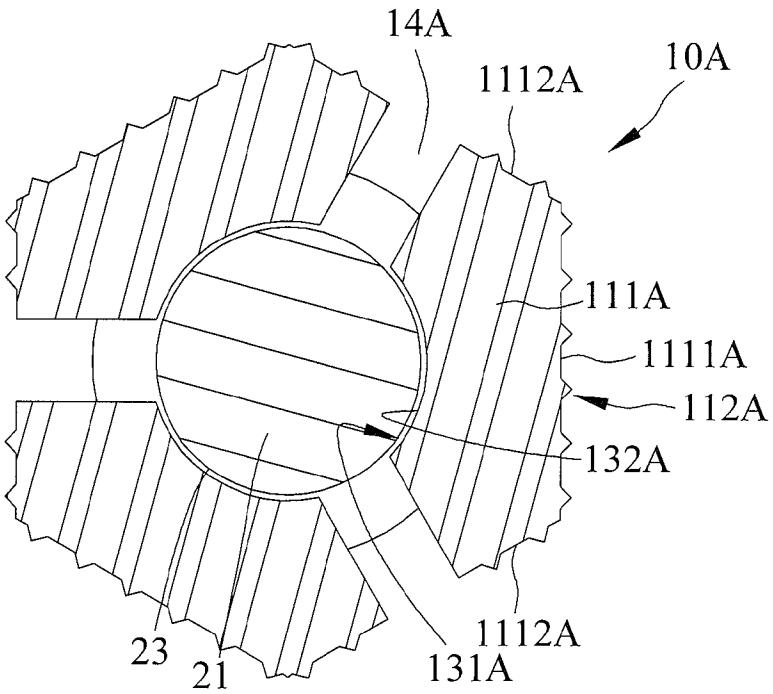
FIG. 16 is a cross-sectional view of a wrenching device in accordance with a second embodiment of the present invention.

FIG. 16 shows a wrenching device in accordance with a second embodiment thereof, wherein like numerals are utilized to denote similar elements of the first embodiment, however, bearing a suffix "A". The second embodiment includes a driving member 10A shows a wrenching device in accordance with a third embodiment thereof, wherein like numerals are utilized to denote similar elements of the first embodiment, however, bearing a suffix "B". The third embodiment includes a driving member 10B including an engaging portion 111B which includes a plurality of segments each modified from the first embodiment by eliminating the second engaging surface 1112. Additionally, each segment of the engaging portion 111B includes a first engaging surface 1111B and an auxiliary engaging portion 112B flush with the first engaging surface 1111B.

In view of the foregoing, when loosening/tightening a fastener which includes a hole defined therein for engagement with the wrenching device, the engaging portion 111 of the driving member 10 is adapted to be expanded radially out to push or abut against a peripheral wall of the hole in a manner to prevent rotation with respect to the fastener when being turned, which is often a problem encountered when the hole is rusted, rotten or damaged. Additionally, each auxiliary engaging portion 112, 112A, 112B is adapted to push or abut against the peripheral wall of the hole of the fastener. Accordingly, each auxiliary engaging portion 112, 112A, 112B is adapted to prevent the related engaging portion 111, 111A, 111B from rotation with respect to the fastener when being turned.

While the specific embodiments have been illustrated and described, numerous modifications come to mind without significantly departing from the spirit of invention, and the scope of invention is only limited by the scope of the accompanying claims.

What is claimed is:

1. A wrenching device comprising:

a driving member extending from a first end to a second end and including a hole and a slit defined therein, with the first end defining an engaging portion, with the slit communicating with the hole;

an actuating member moveably disposed in the hole of the driving member; and a control member including a connecting end pivotally joining to the actuating member and including first and second engaging sides selectively abutting against a wall defined on the driving member in response to first and second operating positions thereof, respectively;

wherein the actuating member is moved in a direction urging the engaging portion to expand radially out as the control member is pivoted from the first to the second operation position; and wherein the driving member includes a lug extending from the wall.

2. The wrenching device as claimed in claim 1, wherein the slit extends radially from an inner periphery to an outer periphery of the driving member and longitudinally from the first end to a position between the first and second ends.

3. The wrenching device as claimed in claim 1, wherein the hole includes a tapered section delimited by a tapered wall defined from an inner periphery of the driving member and extending from the first end and having a first cross sectional size, to a position between the first and second ends and having a second cross section size reduced from the first cross sectional size.

4. The wrenching device as claimed in claim 3, wherein the actuating member includes a head received in the tapered section when the control member is in the first operating position, and a body pivotally joined to the connecting end of the control member.

5. The wrenching device as claimed in claim 1, wherein the slit includes two spaced lateral walls and a first distal end defining an opening and a second distal end defining a closed end having a diameter larger than a distance between the lateral walls.

6. The wrenching device as claimed in claim 1, wherein the engaging portion includes a plurality of segments in which two adjacent segments are separated by the slit.

7. The wrenching device as claimed in claim 6 further comprising an auxiliary engaging portion disposed on the engaging portion and on an outer periphery of the driving member.

8. The wrenching device as claimed in claim 1 wherein the connecting end includes a receptacle defined therein receiving the lug.

* * * * *